US008220964B1

(12) United States Patent
Martin

(10) Patent No.: US 8,220,964 B1
(45) Date of Patent: Jul. 17, 2012

(54) JACK-O-LANTERN KIT

(76) Inventor: Frank L. Martin, Lakewood, CA (US)

( * ) Notice: Subject to any disclaimer, the term of this patent is extended or adjusted under 35 U.S.C. 154(b) by 380 days.

(21) Appl. No.: 12/571,745

(22) Filed: Oct. 1, 2009

(51) Int. Cl.
*F21S 4/00* (2006.01)
*F21V 15/01* (2006.01)

(52) U.S. Cl. ..... 362/249.16; 362/234; 362/362; 362/806

(58) Field of Classification Search ..... 362/124, 362/234, 240, 249.06, 249.16, 362, 363, 362/806, 808; 446/99, 100
See application file for complete search history.

(56) References Cited

U.S. PATENT DOCUMENTS 741,293 A * 10/1903 Barnes ..... 40/540
764,207 A 7/1904 Robinson
2,748,260 A 5/1956 Nelson
3,264,160 A * 8/1966 Donofrio ..... 29/432
3,822,170 A 7/1974 Smolen
D296,853 S 7/1988 Slater
4,878,873 A * 11/1989 Yamaguchi et al. ..... 446/321
5,091,833 A * 2/1992 Paniaguas et al. ..... 362/191
5,162,138 A 11/1992 Caflisch et al.
D388,360 S 12/1997 Shaw
D404,339 S 1/1999 Hughes
6,200,000 B1 * 3/2001 Burnidge ..... 362/155
6,318,882 B1 * 11/2001 Chang ..... 362/235
D481,651 S 11/2003 Homesley
6,681,469 B2 * 1/2004 Damon ..... 29/432
7,237,922 B2 * 7/2007 Cayton ..... 362/186
7,448,773 B2 * 11/2008 Lai ..... 362/264
2008/0198599 A1 * 8/2008 Lai ..... 362/252

* cited by examiner

*Primary Examiner* — Alan Cariaso

(57) ABSTRACT

A jack-o-lantern kit includes a housing that has a bottom wall, a top wall and a perimeter wall that is attached to and extends between the top and bottom walls. The housing has a hollow interior space. The perimeter wall has an opening therein defining a mouth of a jack-o-lantern. The housing has a shape and size resembling a pumpkin. Each of a plurality of decorating attachments is removably coupled to the housing at a selected position to alter an appearance of the housing. A plurality of light emitters is mounted within the housing and a power source is electrically coupled to each of said light emitters.

6 Claims, 5 Drawing Sheets

JACK-O-LANTERN KIT

BACKGROUND OF THE DISCLOSURE

Field of the Disclosure

The disclosure relates to Halloween decorating devices and more particularly pertains to a new Halloween decorating device for providing a re-usable jack-o-lantern and means for decorating the same.

SUMMARY OF THE DISCLOSURE

An embodiment of the disclosure meets the needs presented above by generally comprising a housing that has a bottom wall, a top wall and a perimeter wall that is attached to and extends between the top and bottom walls. The housing has a hollow interior space. The perimeter wall has an opening therein defining a mouth of a jack-o-lantern. The housing has a shape and size resembling a pumpkin. Each of a plurality of decorating attachments is removably coupled to the housing at a selected position to alter an appearance of the housing. A plurality of light emitters is mounted within the housing and a power source is electrically coupled to each of said light emitters.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
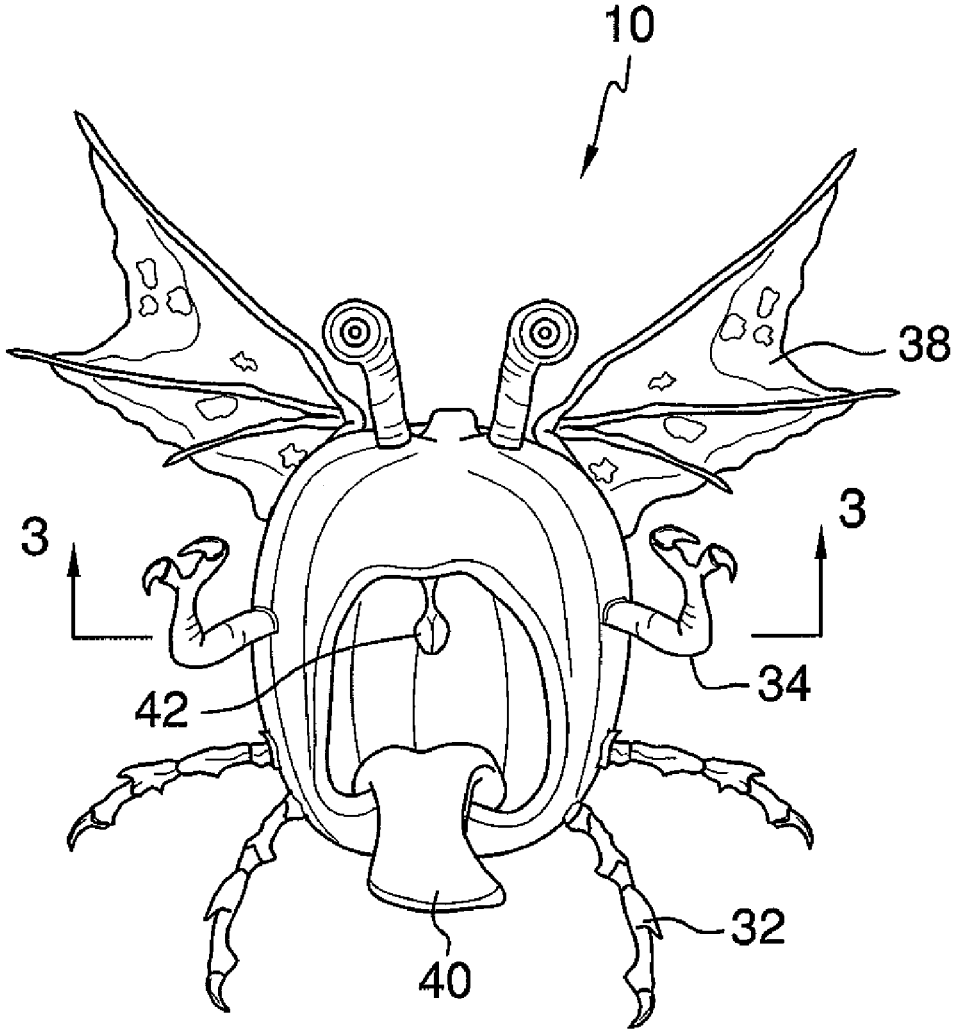
FIG. 1 is a front view of a jack-o-lantern kit according to an embodiment of the disclosure.
Figure 2:
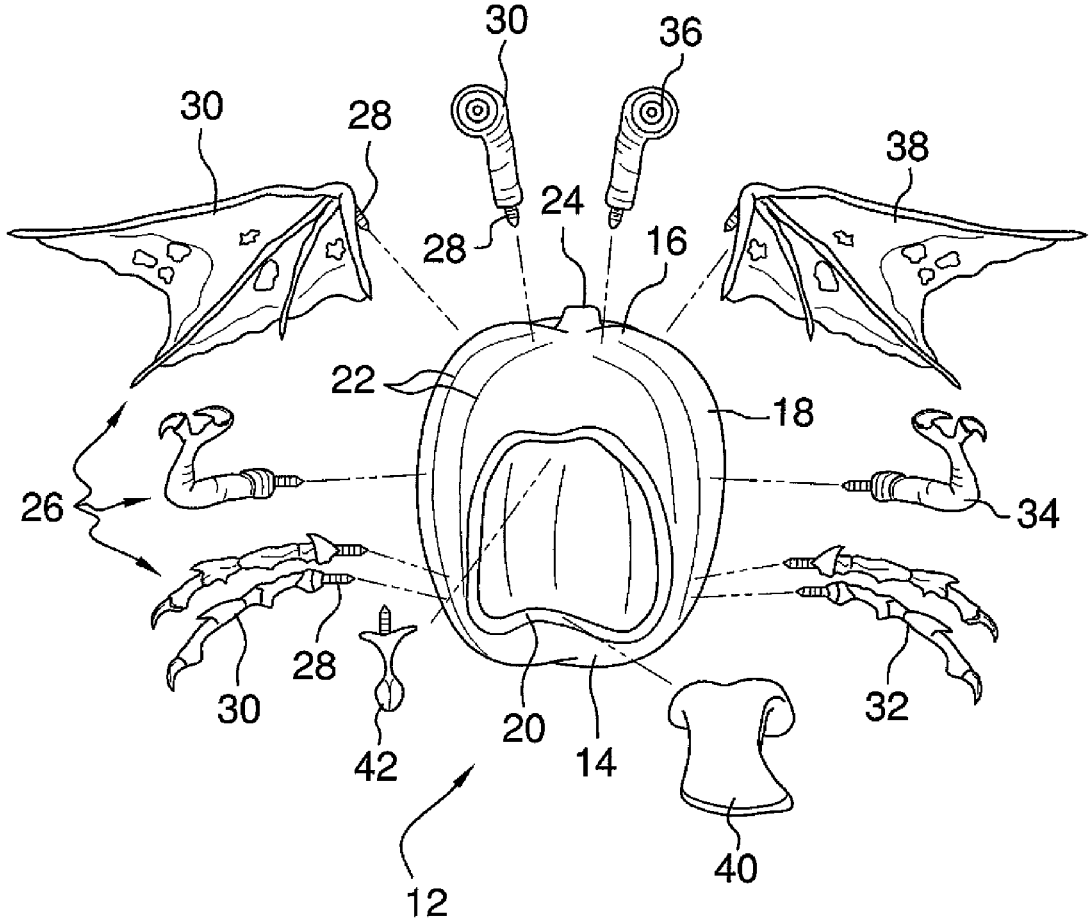
FIG. 2 is a front expanded view of an embodiment of the disclosure.
Figure 3:
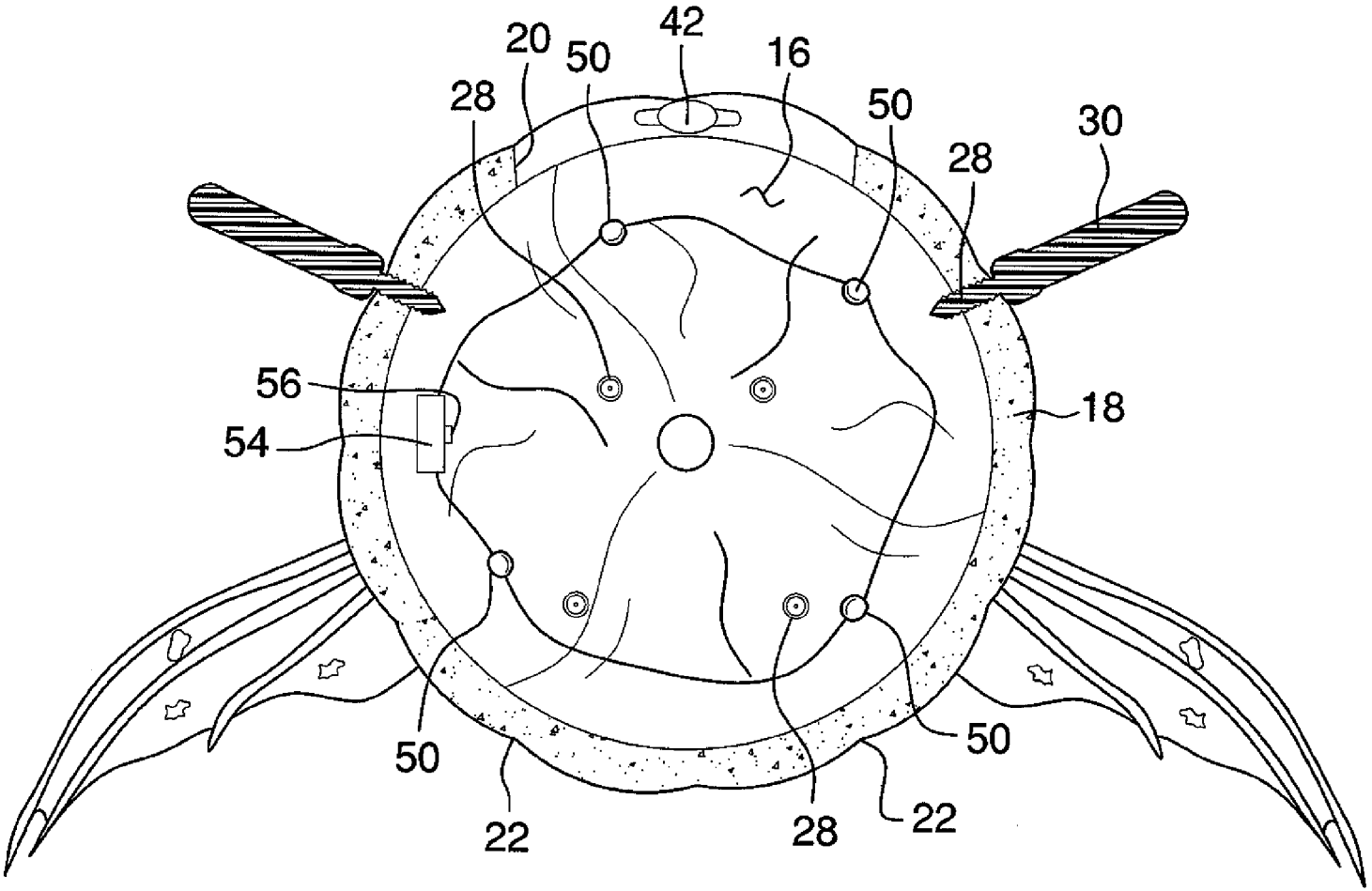
FIG. 3 is a cross-sectional view taken along line 3-3 of FIG. 1 of an embodiment of the disclosure.

With reference now to the drawings, and in particular to FIGS. 1 through 5 thereof, a new Halloween decorating device embodying the principles and concepts of an embodiment of the disclosure and generally designated by the reference numeral 10 will be described.

As best illustrated in FIGS. 1 through 5, the jack-o-lantern kit 10 generally comprises a housing 12 that has a bottom wall 14, a top wall 16 and a perimeter wall 18 that is attached to and extends between the top 16 and bottom 14 walls. The housing 12 has a hollow interior space. The perimeter wall 18 has an opening 20 therein defining a mouth of a jack-o-lantern. The opening 20 may have a height equal to at least one half of a height of the perimeter wall 18 to provide easy access to an interior of the housing 12 as the top 16 and bottom 14 walls may be integrally coupled to the perimeter wall 18. The housing 12 has a shape and size resembling a pumpkin. In particular, it will be colored a shade of orange and will have longitudinally elongated depressions 22 therein. Further, the top wall 16 may include a nub 24 resembling a stem of a pumpkin. The housing 12 is comprised of a foamed plastic material or a foamed elastomeric material.

Figure 4:
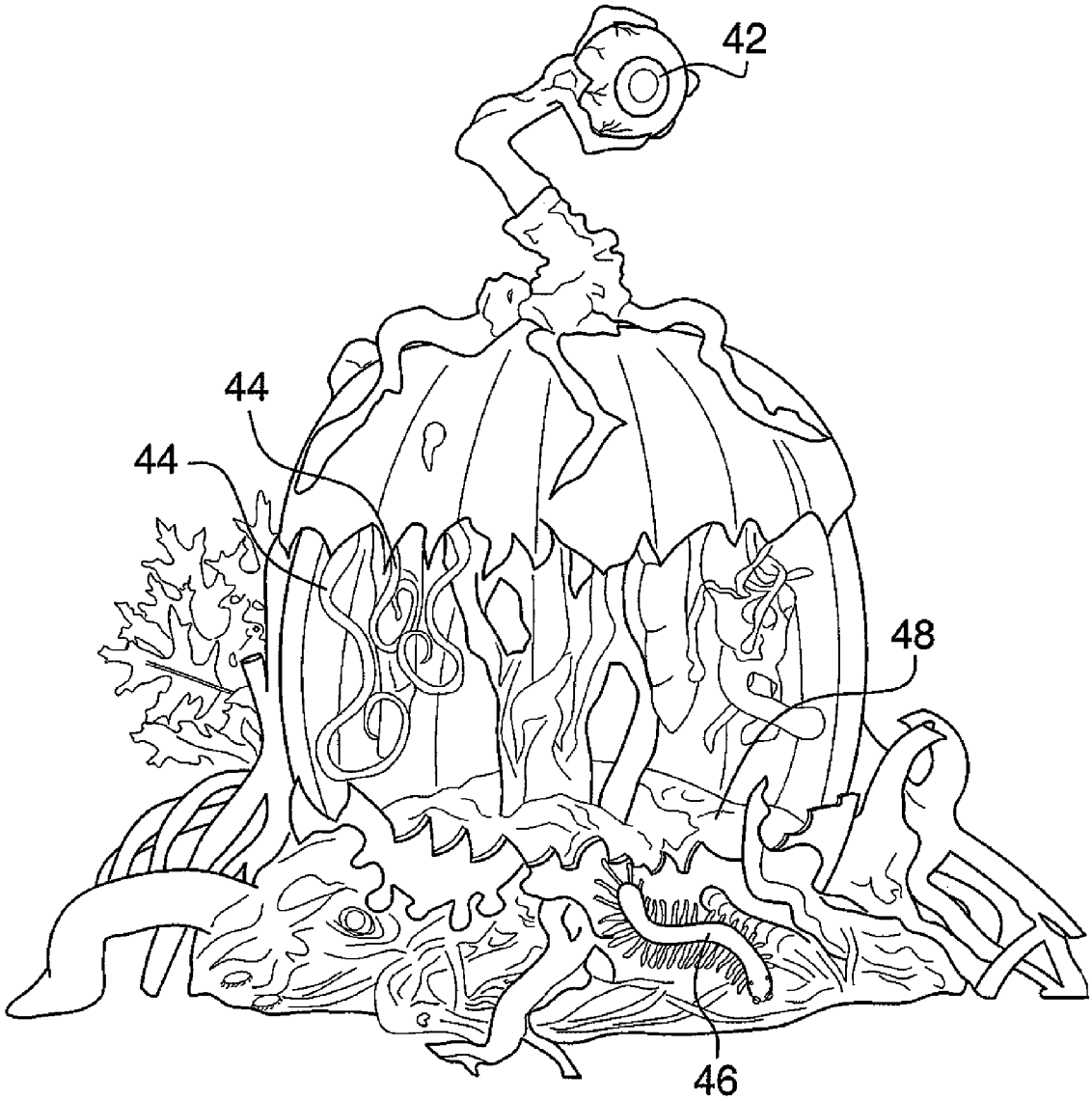
FIG. 4 is a front view of an embodiment of the disclosure.
Figure 5:
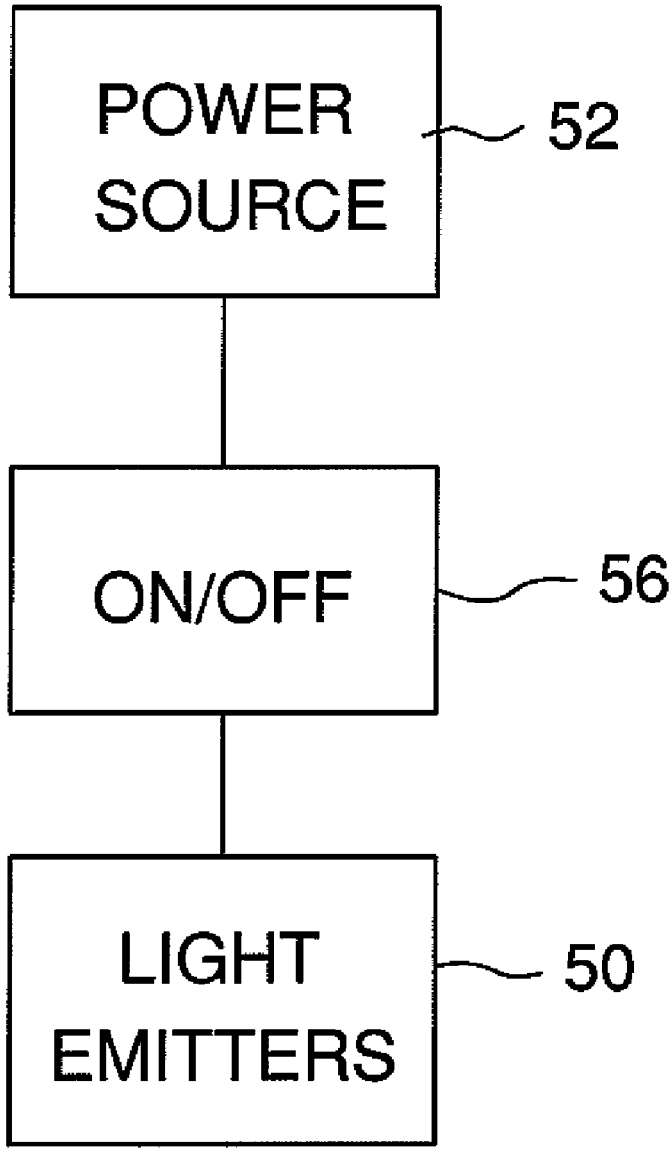
FIG. 5 is a schematic view of an embodiment of the disclosure.

A plurality of decorating attachments 26 is provided. Each of the decorating attachments 26 is removably coupled to the housing 12 at a selected position to alter an appearance of the housing 12. Each of the decorating attachments 26 includes a prong 28 and a decorative portion 30 non-removably attached together. The prongs 28 of each of the decorating attachments 26 are removably extendable into one of the top 16, bottom 14 or perimeter 18 walls to extend an associated one of the decorative portions 30 away from the housing 12. Each of the prongs 28 is threaded to enhance a connection between the decorating attachments 26 and the housing 12. The plurality of decorative attachments 26 includes leg members 32, arm members 34, eye members 36, wing members 38, at least one tongue member 40 and at least one uvula member 42. Additional material may be added as is shown in FIG. 4 to include worm attachments 44, insects 46, intestines 48 and the like.

A plurality of light emitters 50 is mounted within the housing 12. Power source 52, which may be battery 54 mounted within the housing 12, is electrically coupled to each of the light emitters 50. An actuator 56 is in electrical communication with the battery 54 to selectively turn the light emitters 50 on or off. Each of the light emitters 50 comprises a light emitting diode. The light emitters 50 may be colored.

In use, a user of the kit 10 adds the decorating attachments 26 to the housing as they see fit, with FIG. 1 being one example. The decorating attachments 26 allow for multiple configurations and the housing 12 does not require the use of a real pumpkin. The light emitters 50 provide an eerie ambiance for the housing 12 without creating a fire hazard.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A jack-o-lantern kit assembly comprising:

a housing having a bottom wall, a top wall and a perimeter wall being attached to and extending between said top and bottom walls, said housing having a hollow interior space, said perimeter wall having an opening therein defining a mouth of a jack-o-lantern, said housing having a shape and size resembling a pumpkin;

a plurality of decorating attachments, each of said decorating attachments being removably coupled to said housing at a selected position to alter an appearance of said housing, said plurality of decorative attachments consists of at least two leg members, at least two arm members, at least two eye members, at least two wing members, at least one tongue member and at least one uvula member; and a plurality of light emitters being mounted within said housing, a power source being electrically coupled to each of said light emitters.

2. The assembly according to claim 1, wherein said opening has a height equal to at least one half of a height of said perimeter wall.

3. The assembly according to claim 1, wherein said housing consists of a foamed plastic material or a foamed elastomeric material.

4. The assembly according to claim 1, wherein each of said decorating attachments includes a prong and a decorative portion non-removably attached together, said prongs of each of said decorating attachments being removably extendable into one of said top, bottom or perimeter walls to extend an associated one of said decorative portions away from said housing.

5. The assembly according to claim 4, wherein each of said prongs is threaded.

6. A jack-o-lantern kit assembly comprising:

a housing having a bottom wall, a top wall and a perimeter wall being attached to and extending between said top and bottom walls, said housing having a hollow interior space, said perimeter wall having an opening therein defining a mouth of a jack-o-lantern, said opening having a height equal to at least one half of a height of said perimeter wall, said housing having a shape and size resembling a pumpkin, said housing being comprised of a foamed plastic material or a foamed elastomeric material;

a plurality of decorating attachments, each of said decorating attachments being removably coupled to said housing at a selected position to alter an appearance of said housing, each of said decorating attachments including a prong and a decorative portion non-removably attached together, said prongs of each of said decorating attachments being removably extendable into one of said top, bottom or perimeter walls to extend an associated one of said decorative portions away from said housing, each of said prongs being threaded, said plurality of decorative attachments including leg members, arm members, eye members, wing members, at least one tongue member and at least one uvula member; and a plurality of light emitters being mounted within said housing, a battery being mounted within said housing and being electrically coupled to each of said light emitters, an actuator being in electrical communication with said battery to selectively turn said light emitters on or off, each of said light emitters comprising a light emitting diode.

* * * * *